US008567223B2

(12) United States Patent
Golovashchenko et al.

(10) Patent No.: US 8,567,223 B2
(45) Date of Patent: Oct. 29, 2013

(54) METHOD AND TOOL FOR EXPANDING TUBULAR MEMBERS BY ELECTRO-HYDRAULIC FORMING

(75) Inventors: Sergey Fedorovich Golovashchenko, Beverly Hills, MI (US); John Joseph Francis Bonnen, Milford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 864 days.

(21) Appl. No.: 12/563,191

(22) Filed: Sep. 21, 2009

(65) Prior Publication Data

US 2011/0067470 A1 Mar. 24, 2011

(51) Int. Cl.
*B21D 26/02* (2011.01)

(52) U.S. Cl.
USPC ..... 72/56; 72/58; 72/61; 72/370.22

(58) Field of Classification Search
USPC ..... 72/370.22, 60–62, 54, 56, 58
See application file for complete search history.

(56) References Cited

U.S. PATENT DOCUMENTS

| | | | | |
|---|---|---|---|---|
| 1,542,983 | A | 6/1925 | Bergmann, Jr. | |
| 3,222,902 | A | 12/1965 | Brejcha et al. | |
| 3,253,442 | A | 5/1966 | Grove, Jr. et al. | |
| 3,273,365 | A | 9/1966 | Felts | |
| 3,338,080 | A | 8/1967 | Golden | |
| 3,348,402 | A | 10/1967 | Reistad | |
| 3,394,569 | A | 7/1968 | Smith | |
| 3,423,979 | A | 1/1969 | Smith et al. | |
| 3,434,194 | A | 3/1969 | Whittaker et al. | |
| 3,512,384 | A | 5/1970 | Inoue | |
| 3,555,866 | A | 1/1971 | Roth | |
| 3,572,072 | A | 3/1971 | Hundley et al. | |
| 3,575,631 | A | 4/1971 | Pratt | |
| 3,603,127 | A | 9/1971 | Seiffert | |
| 3,650,134 | A * | 3/1972 | Haeusler | 72/56 |
| 3,688,535 | A | 9/1972 | Keinanen et al. | |
| 3,750,441 | A | 8/1973 | Schneider et al. | |
| 3,759,551 | A | 9/1973 | Broske | |
| 3,786,662 | A | 1/1974 | Roth | |
| 3,857,265 | A * | 12/1974 | Howeler et al. | 72/56 |

(Continued)

FOREIGN PATENT DOCUMENTS

| | | |
|---|---|---|
| GB | 1068440 | 5/1967 |
| GB | 1241343 | 8/1971 |
| GB | 1252997 | 11/1971 |

OTHER PUBLICATIONS

V. Psyk et al., Electromagnetic Compression as Preforming Operation for Tubular Hydroforming Parts, 1st International Conference on High Speed Forming 2004, Chair of Forming Technology, University of Dortmund, Germany, pp. 171-180.

*Primary Examiner* — Dana Ross
*Assistant Examiner* — Matthew G Katcoff
(74) *Attorney, Agent, or Firm* — Damian Porcari; Brooks Kushman P.C.

(57) ABSTRACT

An electro-hydraulic forming tool having one or more electrodes for forming parts with sharp corners. The electrodes may be moved and sequentially discharged several times to form various areas of the tube. Alternatively, a plurality of electrodes may be provided that are provided within an insulating tube that defines a charge area opening. The insulating tube is moved to locate the charge area opening adjacent one of the electrodes to form spaced locations on a preform. In other embodiments, a filament wire is provided in a cartridge or supported by an insulative support.

5 Claims, 6 Drawing Sheets

(56) References Cited

U.S. PATENT DOCUMENTS

| | | | | |
|---|---|---|---|---|
| 4,285,224 | A * | 8/1981 | Shkatov et al. | 72/56 |
| 4,330,918 | A | 5/1982 | Whitted, III | |
| 5,611,230 | A | 3/1997 | Chelluri et al. | |
| 5,826,320 | A | 10/1998 | Rathke et al. | |
| 6,094,809 | A | 8/2000 | Grassi | |
| 6,591,649 | B1 * | 7/2003 | Gafri et al. | 72/56 |
| 6,708,542 | B1 * | 3/2004 | Gafri et al. | 72/56 |
| 6,766,678 | B1 | 7/2004 | Schulze et al. | |
| 6,875,964 | B2 | 4/2005 | Golovashchenko et al. | |
| 7,256,373 | B2 | 8/2007 | Gafri et al. | |
| 7,269,986 | B2 | 9/2007 | Pfaffmann et al. | |
| 7,395,597 | B2 | 7/2008 | Shao et al. | |
| 7,493,787 | B2 | 2/2009 | Golovashchenko et al. | |
| 2006/0107715 | A1 | 5/2006 | Imamura et al. | |

* cited by examiner

METHOD AND TOOL FOR EXPANDING TUBULAR MEMBERS BY ELECTRO-HYDRAULIC FORMING

STATEMENT REGARDING FEDERALLY SPONSORED RESEARCH OR DEVELOPMENT

This invention was made with U.S. Government support under Contract No. DE-FG36-08GO18128 awarded by the Department of Energy. The Government has certain rights in this invention.

BACKGROUND

1. Technical Field

The present invention relates to electro-hydraulic forming to expand a tubular member in a die.

2. Background Art

In electro-hydraulic forming ("EHF"), an electric arc discharge is used to convert electrical energy to mechanical energy. A capacitor bank, or other source of stored charge, delivers a high current pulse across two electrodes that are submerged in a fluid, such as oil or water. Electric arc discharge vaporizes the surrounding fluid and creates shock waves. A workpiece that is in contact with the fluid may be deformed by the shock wave to fill an evacuated die.

Electro-hydraulic forming may be used, for example, to form a flat blank into a one-sided die. The use of EHF for a one-sided die may save tooling costs and may also facilitate forming parts into shapes that are difficult to form by conventional press forming or hydroforming techniques. Electro-hydraulic forming also facilitates forming high strength steel, aluminum and copper alloys. For example, advanced high strength steel (AHSS) and ultra high strength steel (UHSS) can be formed to a greater extent with electro-hydraulic forming techniques when compared to other conventional forming processes. Lightweight materials, such as AHSS and UHSS and high strength aluminum alloys are lightweight materials that are used to reduce the weight of vehicles.

The use of high strength, lightweight materials is increasing and has been proposed for hydroforming tubes. Tube hydroforming is a well-known technology that is currently used in production. One problem with conventional hydroforming of tubes is that increased pressure is required to fill sharp corners in local areas of the tube. The reduced formability of high strength steel and aluminum exacerbates the problems associated with forming sharp corners in localized areas of the parts when compared with forming such parts with mild steel. To form a tube having sharp corners, increased pressure is required in the hydroforming liquid that must be applied to all of the internal surfaces of the tube. To withstand the increased pressure, it is necessary to employ high tonnage presses and may require tens of thousands of pounds of pressure.

The above problems are addressed by Applicants' invention as summarized below.

SUMMARY

It is proposed to use electro-hydraulic forming instead of or in addition to hydroforming to form high strength parts that have sharp corners in highly formed localized areas. A pair of electrodes can be positioned inside the tube and a number of sequential discharges may be utilized to form various areas of the tube when using electro-hydraulic forming.

In another embodiment, a single electrode may be moved to various locations within the tube and an electric arc discharge may be created between the electrode and part or die that are connected to a second electrode.

In yet another embodiment, a plurality of electrodes may be provided within the tube and an insulating shield may be moved to permit an electric arc discharge between one of the electrodes and the tube wall.

In a further embodiment, a discharge wire filament may be provided in a water filled tube cartridge that may be inserted in one or both ends of the tubular member. If a discharge wire filament is used, a wider area of the tube may be formed by the electric arc discharge through the wire.

In yet another embodiment, a discharge wire filament may be held by an insulating support and placed in contact with a tube wall.

The above embodiments may be inserted in a tubular member from one or both sides of the tubular member.

The above embodiments are described in detail below with reference to the attached drawings.

DETAILED DESCRIPTION

Figures 1A, 1B:
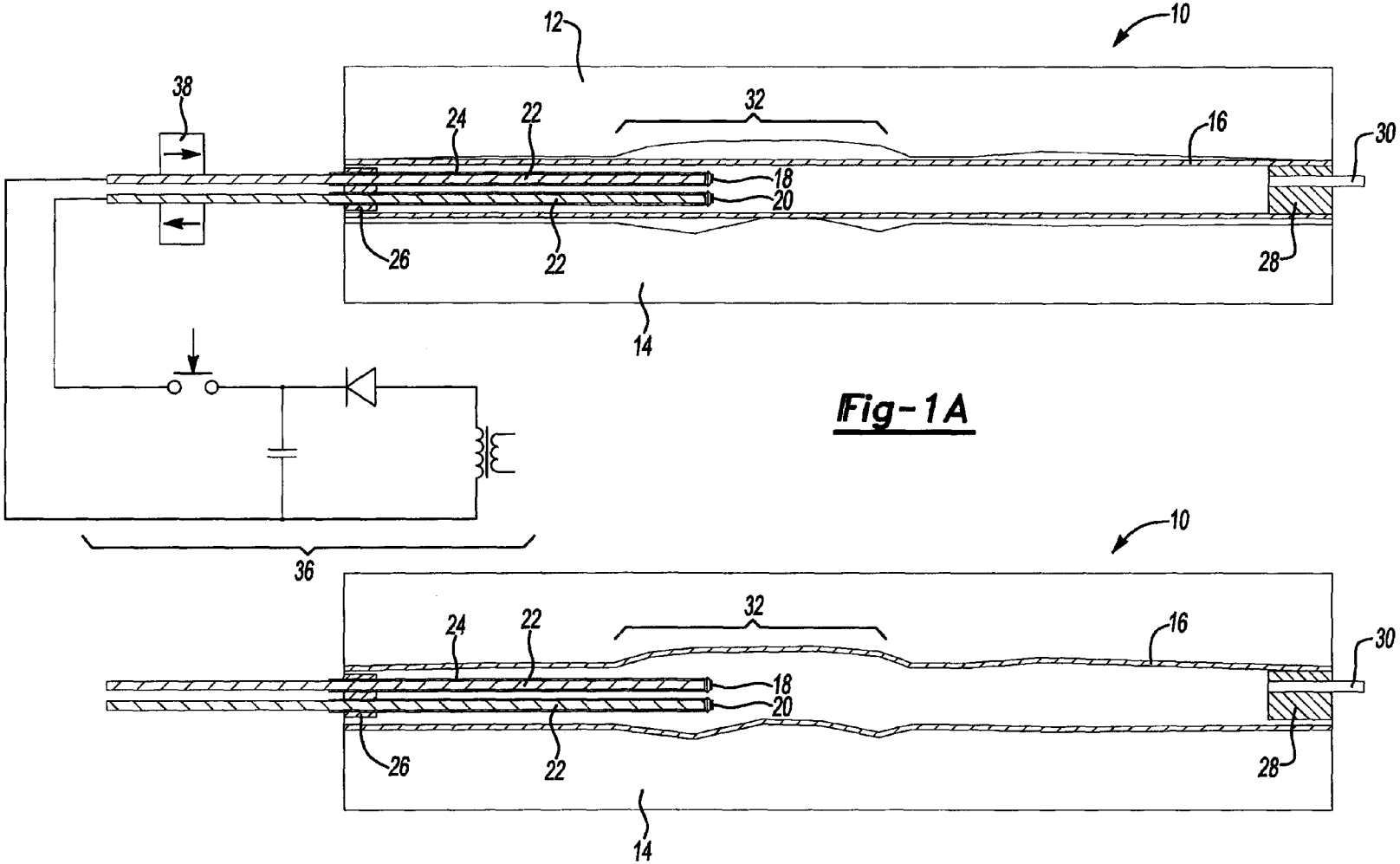
FIG. 1A is a diagrammatic view of a electro-hydraulic tube forming tool with two electrodes submerged in the tube before forming.
FIG. 1B is a diagrammatic view of a electro-hydraulic tube forming tool with two electrodes submerged in the tube after forming.

Referring to FIGS. 1A and 1B, an electro-hydraulic forming ("EHF") tool 10 is shown diagrammatically to include an upper die 12 and a lower die 14. A tubular pre-form 16, or blank, is disposed within the upper and lower dies 12 and 14 and is shown in its unformed condition in FIG. 1A and is shown in FIG. 1B after forming with the tube conforming to the die. It should be understood that the tubular pre-form is initially smaller than the die cavity, but then expanded as a result of one or more electro-hydraulic forming discharges to fill the cavity defined by the upper and lower dies 12 and 14.

A first electrode 18 and a second electrode 20 are inserted within the tubular pre-form 16 and are submerged in water or oil, as is well known in electro-hydraulic forming processes.

The first and second electrodes 18 and 20 are replaceable and are attached to the distal end of leads 22 that are each covered by an insulating sleeve 24 to prevent arcing between the leads 22.

An end electrode seal 26 is provided at one of the tool 10 that receives the leads 22 and insulating sleeves 24 of the first and second electrodes 18 and 20. The end electrode seal 26 seals the tubular pre-form 16 on one end while an end fill seal 28 is provided at the other end of the tubular pre-form 16 to seal the other end thereof. The end fill seal 28 includes a port 30 through which a fluid, such as oil or water, is provided to the inside of the tubular pre-form 16. The tubular pre-form 16 is evacuated through the port 30 so that the pre-form 16 is substantially completely filled with the fluid when the EHF tool 10 discharges between the first and second electrodes 18 and 20.

After each discharge, additional fluid may be provided through the port 30. The fluid is supplied to the tube 16 at a pressure that is less than 20 psi to fill the tube. The pressure is released after the tube is filled. The EHF tool 10 may be discharged multiple times to form different localized areas of the tubular pre-form 16. Multiple discharges between the first and second electrodes 18 and 20 may be provided within tube 16 in a contoured area 32 where sharp corners may be required to be formed in the tubular member 16.

A stored charge circuit 36, or pulse generator, is illustrated in FIG. 1. The stored charge circuit 36 is connected to the lead 22. To perform an electro-hydraulic forming cycle, the stored charge circuit 36 is actuated to create a discharge between the first and second electrodes 18 and 20. After the tubular pre-form 16 is fully formed, the fluid is drained through the port 30 and the die may be opened for removal of the fully formed pre-form 16.

A linear drive 38 is provided to move the electrodes 18 and 20 within the tubular member 16. The linear drive 38 may be a hydraulic cylinder, a pneumatic cylinder or motor drive that is capable of moving the first and second electrodes 18 within the tubular pre-form 16. The linear drive 38 moves the electrodes 18 and 20 within the contoured area 32 to be formed by the EHF tool.

Figure 2:
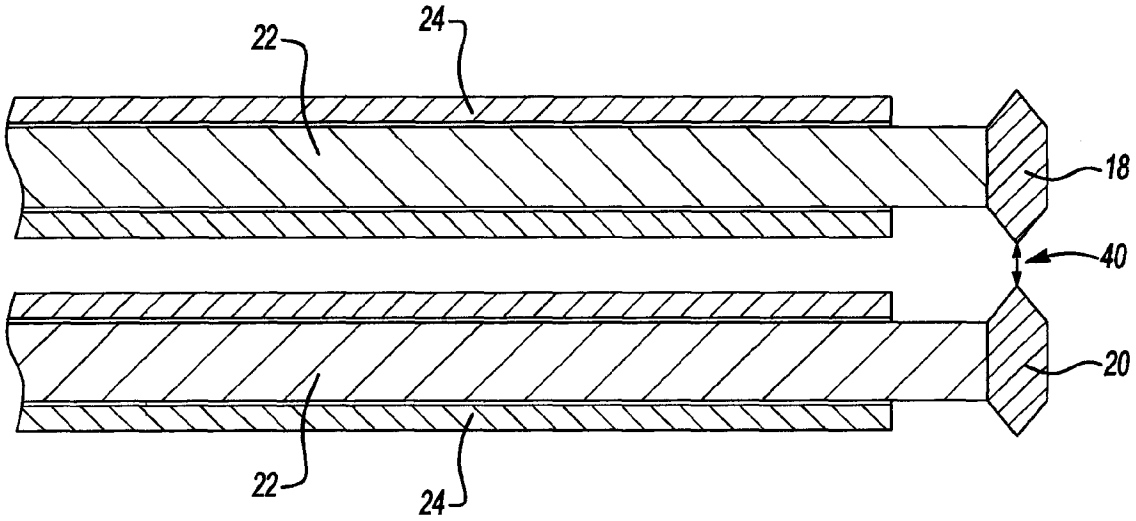
FIG. 2 is a diagrammatic view of the two electrodes of the embodiment shown in FIGS. 1A and 1B.

As shown in FIG. 2, when the electrodes 18 and 20 are positioned adjacent to an area to be formed, the electrodes 18 and 20 are discharged in a discharge zone 40. The charge is conducted from the stored charge circuit 36 through the leads 22 to the first and second electrodes 18 and 20. An arc is formed between the first and second electrodes 18 and 20 in the discharge zone 40.

Figure 4:
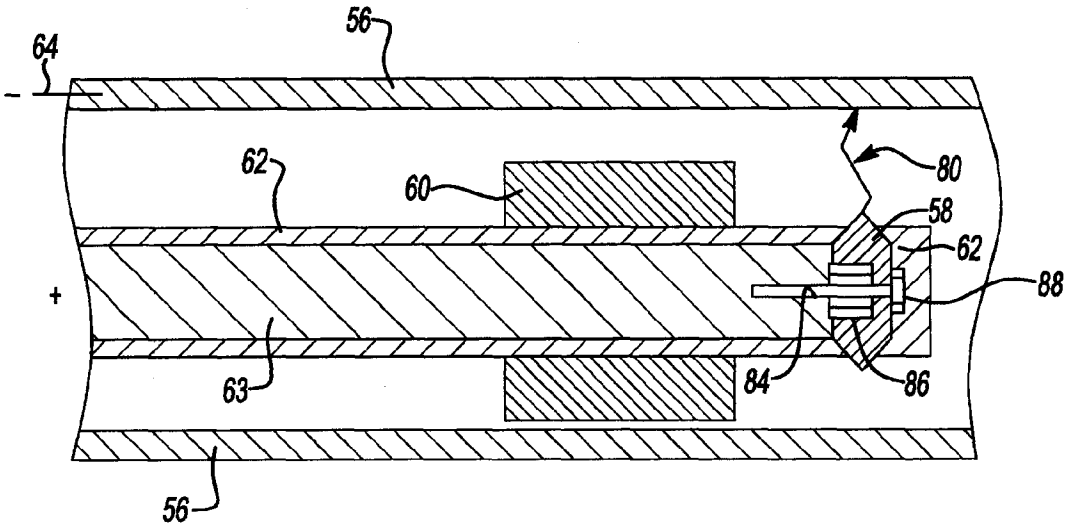
FIG. 4 is a diagrammatic view of the electrode of the embodiment of FIGS. 3A and 3B.
Figure 3A:
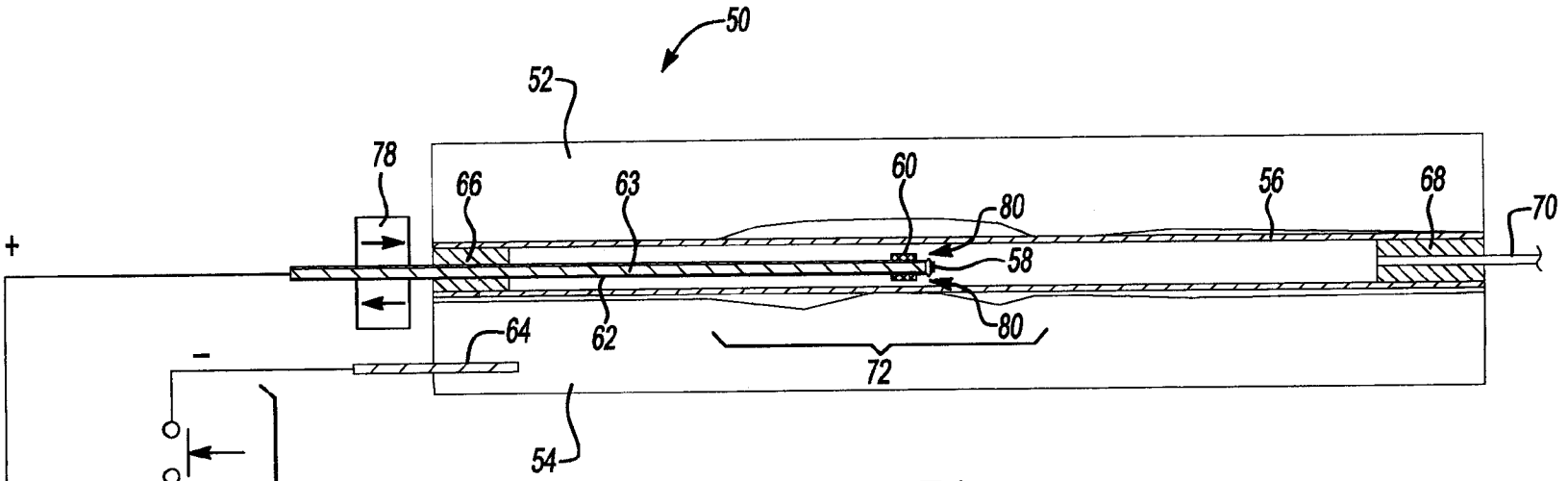
FIG. 3A is a diagrammatic view of an electro-hydraulic tube forming tool having one electrode submerged in the tube with the other electrode being connected to the tube or the die before forming.
Figure 3B:
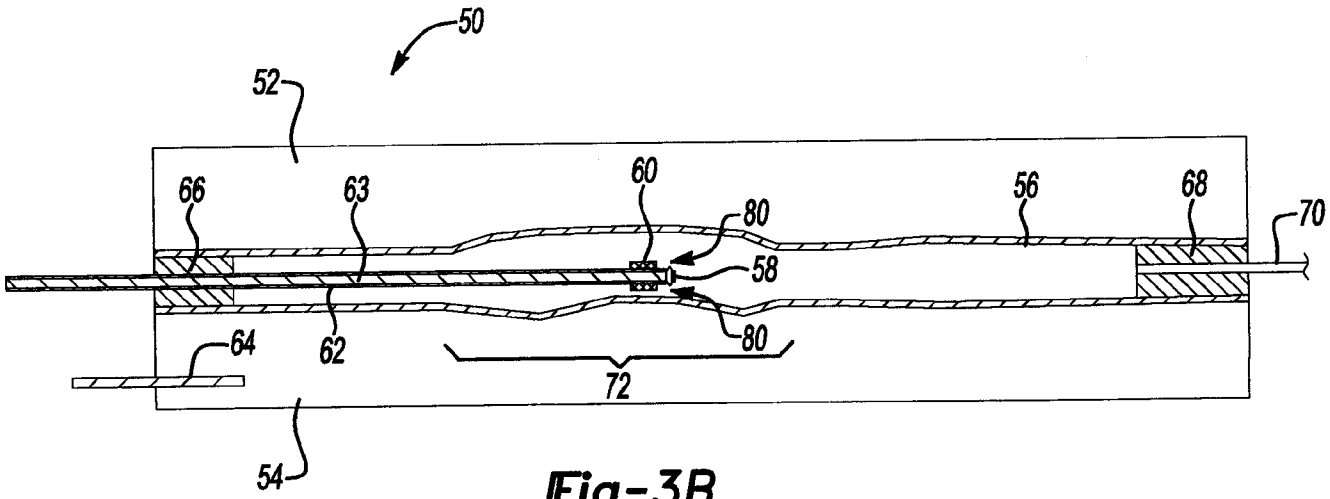
FIG. 3B is a diagrammatic view of an electro-hydraulic tube forming tool having one electrode submerged in the tube with the other electrode being connected to the tube or the die after forming.

Referring to FIGS. 3A, 3B and 4, an alternative embodiment of an EHF tool 50 is shown to include an upper die 52 and a lower die 54. A tubular pre-form 56 is received between the upper and lower dies 52 and 54. A single replaceable electrode 58 is inserted within the tubular pre-form 56. The electrode 58 is provided with an insulating block 60 that insulates the electrode 58 and prevents electrode 58 from contacting the wall of the tubular pre-form 56. An insulating sleeve 62 is also provided to prevent arcing between the lead 63 and the tubular member 56. A second lead 64 may be connected to the upper die 52 or lower die 54 of the EHF tool 50. As shown, the electrode 58 is the positive electrode, while lead 64 is the negative electrode. It should be understood that the polarity of the electrodes can be reversed.

An end electrode seal 66 is provided within one end of the tubular member 56 to provide a seal between the tubular member and the insulating sleeve 62 of the lead 63.

An end fill seal 68 is provided at the opposite end of the tubular pre-form 56 that seals the end of the tubular pre-form 56 when the EHF tool 50 is discharged. A port 70 may be received within the end fill seal 68. Fluid may be introduced into the tubular pre-form 56 through the port 70. If the fluid is water, it should be understood that it may be an emulsion of water and a rust preventative. In addition, air may be evacuated through the port 70 to assure complete filling of the tubular pre-form 56 with the fluid. When the forming cycle is complete, the port 70 may be used to drain the fluid from the tubular pre-form 56.

A contoured area 72 is shown provided in which the tubular pre-form 56 is intended to be expanded by the EHF tool 50.

Referring to FIG. 3, a stored charge circuit 76, or pulse generator, is shown as it is connected to the ends of the leads 63 and 64. The stored charge circuit 76 is preferably a capacitive charge storage device, as is well known in the art. Alternatively, an inductive charge storage device may be used instead of the capacitive charge storage device.

With continuing reference to FIG. 3A, a linear drive 78 is shown engaging the electrode 63. The linear drive 78 is used to move the electrode within the tube 56, especially in the contoured area 72 to provide an EHF pulse when the stored charge circuit 76 is actuated. A discharge zone 80 is also shown in FIG. 3 where the electrode 58 arcs to the inside of the tubular pre-form 56. The pressure created by the arc creates a shockwave that forms the tubular pre-form against the upper and lower dies 52 and 54.

Referring to FIG. 4, the lead 63 and a replaceable tip 58 is shown in greater detail. The lead 63 is enclosed by insulating sleeve 62. The insulating sleeve 62 may extend to the electrode 58 and also may cover the distal end of the electrode to partially insulate, or shield, the electrode. A threaded hole 84 may be provided in the end of the lead 63. In addition, a threaded end 86 may be provided on the lead and a bolt 88 may be inserted through the electrode 58 to secure the electrode 58 to the threaded end 86. Advantageously, the threads of the threaded hole 84 and the threaded end 86 of the lead 63 may be of different pitch to effectively lock the electrode 58 on the end of the lead 63.

As is also shown in FIG. 4, the insulation block 60 prevents contact between the electrode 58 and the tube 56. The insulation block 60 and insulating sleeve 62 prevent any discharges between the lead 63 and the tubular member 56 along the length of the lead 63.

Figure 5:
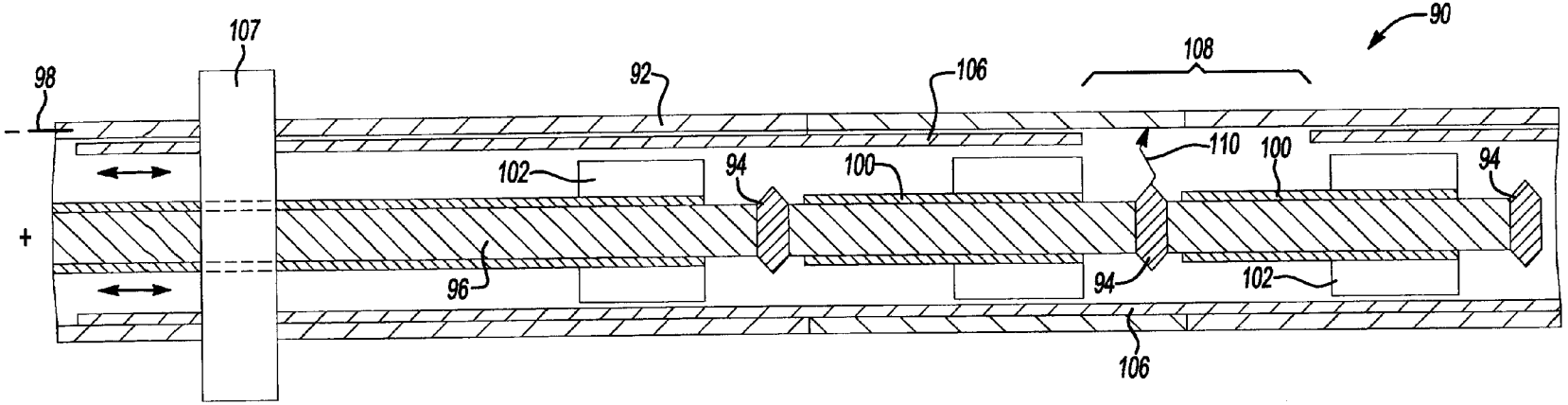
FIG. 5 is a diagrammatic view of an electro-hydraulic tube forming tool having multiple electrodes and a movable insulation tube.

Referring to FIG. 5, an alternative embodiment of an EHF tool 90 is shown that includes a tubular pre-form 92, or blank, in which a plurality of electrodes 94 are inserted. The electrodes 94 are secured to a lead 96. The tubular preform 92 is connected to lead 98. An insulating sleeve 100 and an insulating spacer 102 are provided on the lead 96 to prevent inadvertent discharge between the lead 96 and the wall of the tubular pre-form 92. An insulation tube 106 is provided between the lead 96 and the tubular pre-form 92. The insulation tube 106 is operatively connected to a linear drive 107. The insulation tube 106 defines a charge area opening 108.

The insulation tube 106 prevents arcing between any of the electrodes 94 except where the electrode 94 is disposed adjacent to the charge area opening 108. A discharge area 110 is illustrated diagrammatically by an arrow indicating where the arc is formed between one of the electrodes 94 and the tubular pre-form 92 through the charge area opening 108. The insulation tube 106 prevents arcing between the other electrode 94 and the tubular pre-form 92. The insulation tube 106 is movable to locate the charge area opening 108 adjacent to at least one of the electrodes 94. The insulation tube 106 is movable to permit the tool 90 to act upon several locations within the tubular pre-form 92.

Figure 6:
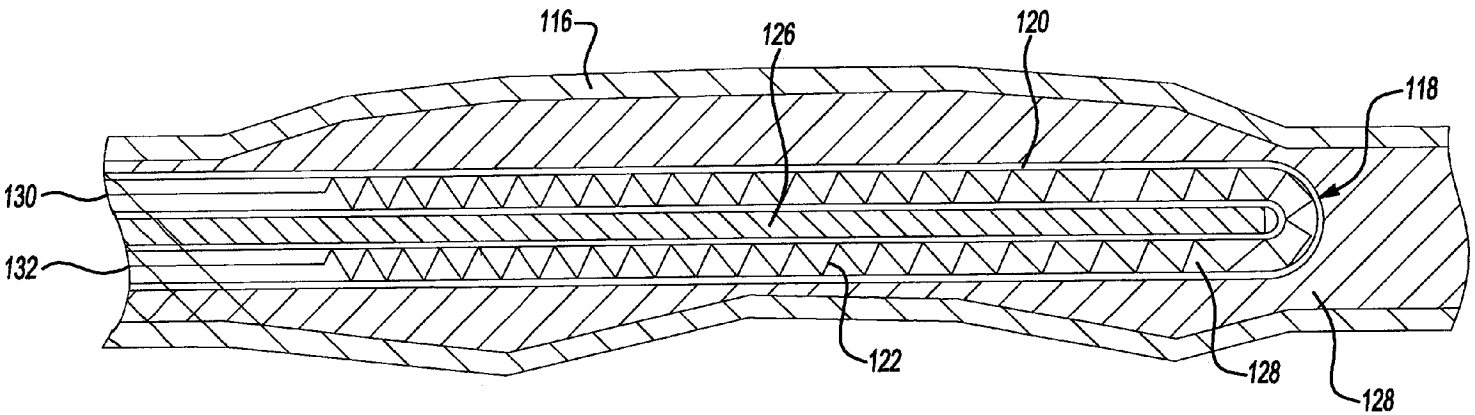
FIG. 6 is a diagrammatic view of an electro-hydraulic tube forming tool in which a cartridge including a filament is inserted in the tube.

Referring to FIG. 6, another alternative embodiment is shown in which a tube 116 may be acted upon by an EHF tool, including an upper and a lower die that are not shown in FIG. 6. However, it should be understood that the EHF tool including an upper and lower die as described with reference to FIGS. 3-4 may be used with the cartridge 118 shown in FIG. 6. The cartridge 118 includes an insulator tube 120 and a filament wire 122. A support 126 is provided to support the filament wire 122 within the insulator tube 120. Fluid 128 is provided both within the cartridge 118 and between the cartridge 118 and the tube 116.

The filament wire 122 is connected to a positive polarity connection 130 and a negative polarity connection 132 on opposite ends. The cartridge 118 may be inserted into the tube 116. A stored charge circuit, such as that disclosed in FIG. 3, is provided to generate an electrical pulse that is provided to the filament wire 122. Upon actuation of the stored charge circuit, the pulse vaporizes the filament wire 122 creating an arc and a shockwave through the fluid 128 causing the tube 116 to be expanded into engagement with the upper and lower die of the EHF tool. The filament 122 may be coiled or otherwise retained between a support 126 and the cartridge 118.

Figure 7:
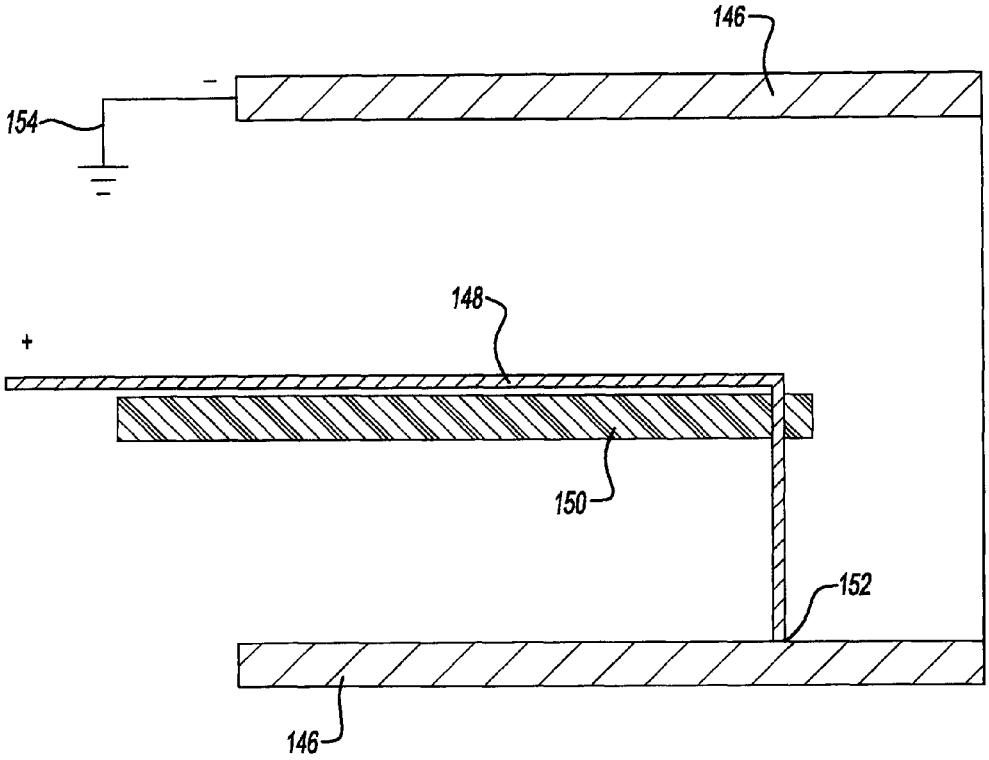
FIG. 7 is a diagrammatic view of an electro-hydraulic tube forming tool having a single wire that contacts the tube and is inserted with a support in a tube.

Referring to FIG. 7, another alternative embodiment is diagrammatically shown wherein a tube 146 is provided in an EHF tool having an upper and lower die similar to that illustrated in FIG. 3. The discharge wire 148 is inserted from one end of the tube and supported by an insulating wire support 150. As previously described, the tube 146 would be filled with fluid and the discharge wire is submerged within the fluid. One end of the discharge wire 148 is placed in contact with the tube 146 at a wall contact point 152. A negative return 154, or ground, is connected to the tube 146.

The discharge wire and negative return 154, or ground, are operatively connected to the stored charge circuit, as previously described with reference to FIG. 3. Upon actuation of the stored charge circuit 76, the electrical discharge through the discharge wire 148 completes the circuit through the tube 146. Upon actuation of the stored charge circuit, the discharge wire is vaporized creating an arc that in turn creates a shockwave that forces the tube 146 into engagement with the upper and lower dies of the EHF tool.

Figure 8:
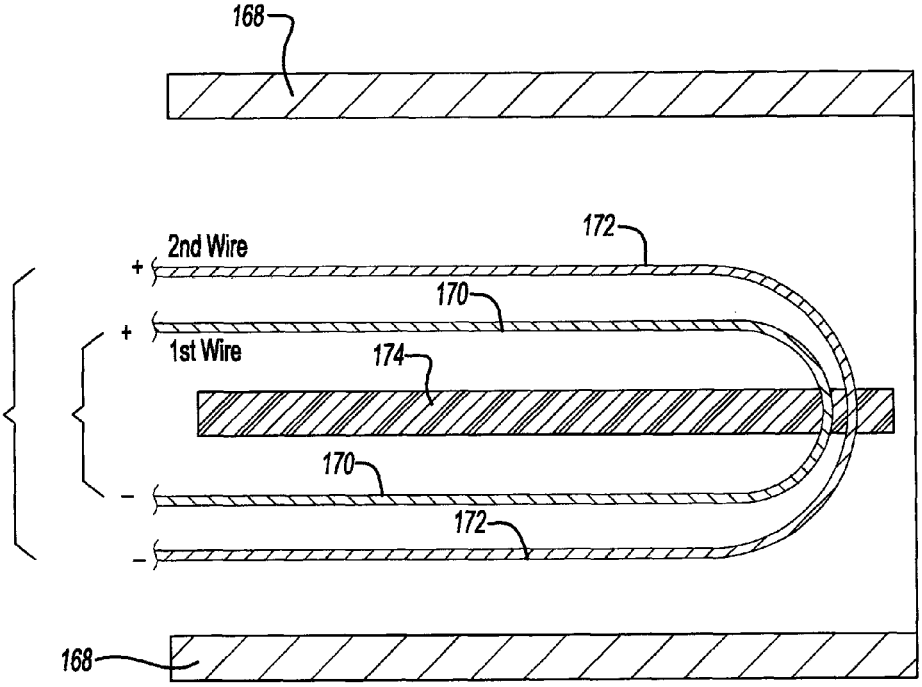
FIG. 8 is a diagrammatic view of a multiple wire electro-hydraulic tube forming tool in which one or more wires are positioned in a tube wherein multiple wires may be used to provide several discharges within the tube.

Referring to FIG. 8, another alternative embodiment is shown in which a tube 168 receives a first wire 170 and a second wire 172 on a wire support 174. As described previously with reference to FIG. 3, an EHF tool including an upper die and a lower die and a stored charge circuit would also be included as part of this embodiment. An insulating support 174 supports the first and second wires to permit multiple discharges within the tube 168.

Upon a first actuation of the stored charge circuit, the first wire 170 receives the discharge and vaporizes to generate a shockwave to drive the wall of the tube 168 into engagement with the die. A second pulse may be provided by the stored charge circuit to the second wire 172 to provide a further forming operation on the tube wall. The insulating and isolating support 174 may be moved within the tube if desired to provide an electro-hydraulic forming pulse in a range of locations within the tube 168. While two wire loops are shown, it should be understood that more wires could be provided within the scope of the invention.

Figure 9:
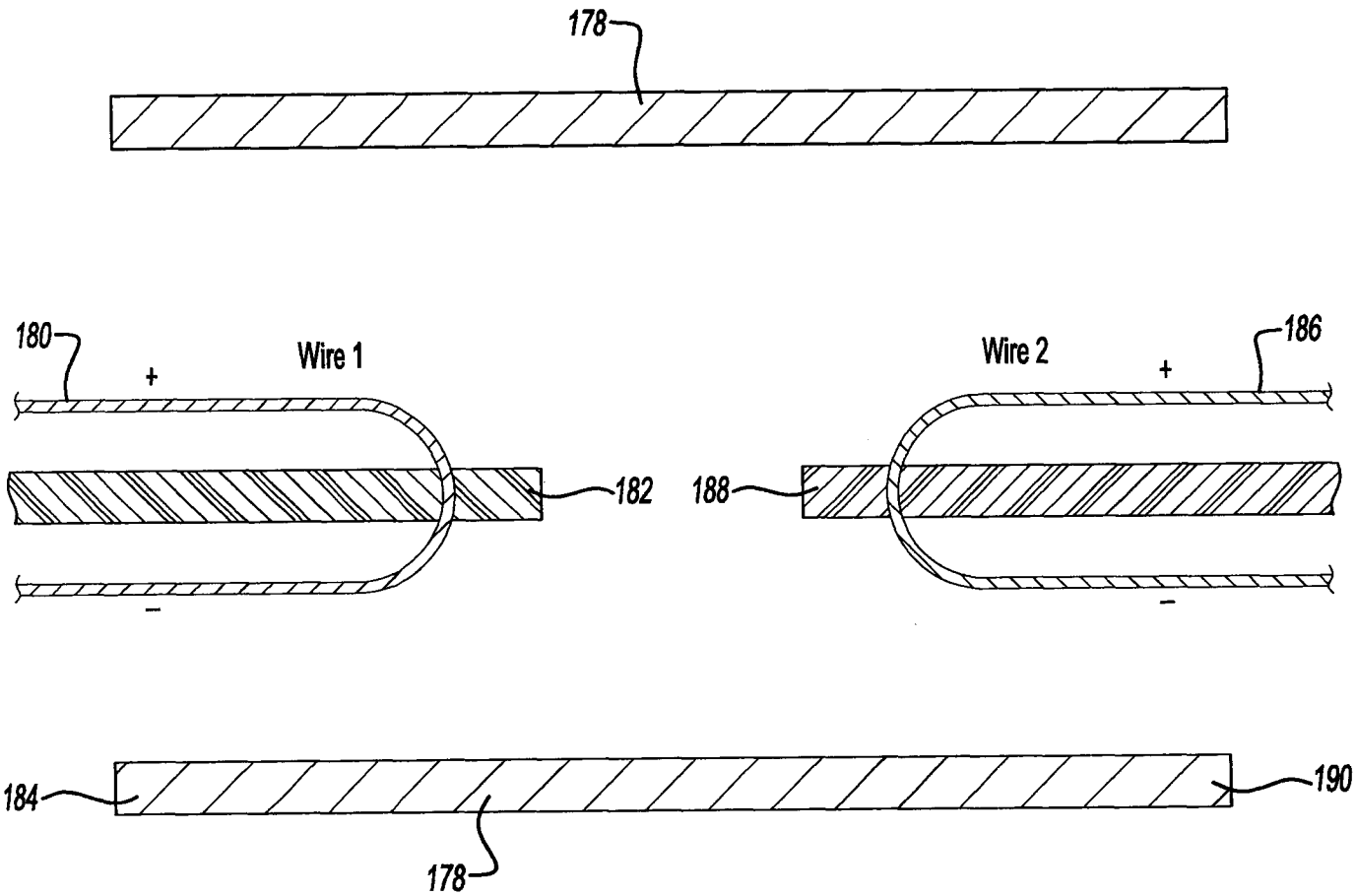
FIG. 9 is a diagrammatic view of an electro-hydraulic tube forming tool wherein opposite ends of the tube may receive a wire on an insulating support to provide multiple discharges within the tube.

Referring to FIG. 9, a tube 178 is shown that may be formed according to a further embodiment of this disclosure. In this embodiment, a first wire 180 is supported by a first support 182. The first wire 180 and first support 182 are inserted through a first end 184 of the tube 178. A second wire 186 supported by a second support 188 is inserted from a second end 190 of the tube 178. In this embodiment, both ends of the tube are used to receive one of the wires 180, 186 from opposite ends.

The concept of providing a wire through opposite ends or of providing an electrode assembly to opposite ends of the tube may be implemented with any previously described embodiments with minor modification. It would be necessary to incorporate an end fill seal and port in one or both of the seals provided at the ends of the tube. By permitting the electrode or electrodes to be inserted from opposite ends of the tube, difficult to reach areas may be accessed by the EHF tool.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A tool for forming a tubular part comprising:
- a tubular member;
- a die into which the tubular member is inserted;
- a first electrode inserted within the tubular member;
- a second electrode electrically connected to the tubular member;
- a fluid provided within the tubular member and in which the first electrode is immersed;
- a linear drive mechanism connected to the first electrode that moves the first electrode in a linear path within the tubular member; and
- an energy storage device;
- a controller that discharges the energy storage device to provide a plurality of sequential electrical discharges between the first and second electrodes through the fluid; and
- wherein the electrical discharges form a plurality of axially spaced localized areas of the tubular member in sequence in the die.

2. The tool of claim 1 further comprising an insulator block disposed about the first electrode that spaces the electrode from the tubular member and insulates the first electrode from the tubular member.

3. The tool of claim 1 wherein the first electrode is connected to the energy storage device by a lead that is provided with insulation to prevent electrical discharges between the first electrode and the second electrode.

4. The tool of claim 1 wherein the first electrode is advanced from one end of the tubular member to the other.

5. The tool of claim 1 wherein the first electrode is provided with an electrode tip that is a circular disk shaped member having a pointed outer circumference.

* * * * *